US009169538B2

(12) United States Patent
Chen

(10) Patent No.: US 9,169,538 B2
(45) Date of Patent: Oct. 27, 2015

(54) ALLOY MATERIAL WITH CONSTANT ELECTRICAL RESISTIVITY, APPLICATIONS AND METHOD FOR PRODUCING THE SAME

(75) Inventor: Swe-Kai Chen, Hsinchu (TW)

(73) Assignee: National Tsing Hua University, Hsinchu (TW)

( * ) Notice: Subject to any disclaimer, the term of this patent is extended or adjusted under 35 U.S.C. 154(b) by 560 days.

(21) Appl. No.: 13/485,403

(22) Filed: May 31, 2012

(65) Prior Publication Data

US 2013/0323116 A1 Dec. 5, 2013

(51) Int. Cl.

| | |
|---|---|
| ***C22C 30/00*** | (2006.01) |
| ***C22C 1/02*** | (2006.01) |
| ***C22C 19/00*** | (2006.01) |
| ***C22F 1/10*** | (2006.01) |

(52) U.S. Cl.
CPC . *C22C 1/02* (2013.01); *C22C 19/00* (2013.01); *C22C 30/00* (2013.01); *C22F 1/10* (2013.01)

(58) Field of Classification Search
CPC ..... C22C 30/00
USPC ..... 420/585
See application file for complete search history.

(56) References Cited

U.S. PATENT DOCUMENTS

| | | | | |
|---|---|---|---|---|
| 2002/0159914 | A1* | 10/2002 | Yeh | 420/580 |
| 2008/0031769 | A1* | 2/2008 | Yeh | 420/580 |
| 2008/0150663 | A1* | 6/2008 | Yeh et al. | 336/83 |
| 2009/0074604 | A1* | 3/2009 | Chen et al. | 419/18 |
| 2009/0301610 | A1* | 12/2009 | Gillon et al. | 148/403 |
| 2010/0047622 | A1* | 2/2010 | Fischer et al. | 428/698 |
| 2010/0132409 | A1* | 6/2010 | Billieres | 65/374.12 |
| 2013/0108502 | A1* | 5/2013 | Bei | 420/591 |

FOREIGN PATENT DOCUMENTS

| | | | | |
|---|---|---|---|---|
| CN | 101418394 A | * | 4/2009 | |
| CN | 102212733 A | * | 10/2011 | |
| JP | 2002173732 A | * | 6/2002 | C22C 30/00 |

OTHER PUBLICATIONS

Wang et al. "Microstructure and compressive properties of AlCrFeCoNi high entropy alloy" Materials Science and Engineering A 491 (2008) 154-158.*

Tung et al. "On the elemental effect of AlCoCrCuFeNi high-entropy alloy system" Materials Letters 61 (2007) 1-5.*

(Continued)

*Primary Examiner* — Kiley Stoner
*Assistant Examiner* — Carlos Gamino
(74) *Attorney, Agent, or Firm* — Ming Chow; Sinorica, LLC

(57) ABSTRACT

An alloy material with a constant electrical resistivity in a wide temperature range comprises the following chemical formula: $Al_vCo_wCr_xFe_yNi_z$, wherein v is in the range of 1.9 to 2.1, w is in the range of 0.9 to 1.1, x is in the range of 0.9 to 1.1, y is in the range of 0.9 to 1.1, and z is in the range of 0.9 to 1.1. A method for producing the alloy material comprises the steps of: providing raw metal materials and mixing them according to the molar ratio of the prescription of the alloy materials; disposing the mixed raw metal materials into a furnace and homogeneously smelting each of the raw metal materials under a protective Ar atmospheric environment; cooling and solidifying the smelted raw metal materials in order to obtain the alloy; and deforming and/or shaping the solidified alloy to predefined figures and dimensions.

7 Claims, 2 Drawing Sheets

(56) References Cited

OTHER PUBLICATIONS

Tong et al. "Microstructure Characterization of AlxCoCrCuFeNi High-Entropy Alloy System with Multiprincipal Elements" Metallurgical and Materials Transactions A vol. 36A, Apr. 2005—881.*

Swe-Kai Chen and Yih-Farn Kao, Near-Constant Resistivity in 4.2-360 K in a B2 Al2.08CoCrFeNi, AIP Advances, Jan. 12, 2012, 012111-1-5, 2, American Institute of Physics, USA.

* cited by examiner

ALLOY MATERIAL WITH CONSTANT ELECTRICAL RESISTIVITY, APPLICATIONS AND METHOD FOR PRODUCING THE SAME

BACKGROUND OF THE INVENTION

1. Field of the Invention

The present invention generally relates to an alloy material with a constant electrical resistivity, applications and a method for producing the same, more particularly to a conductive alloy material that is with a lower temperature coefficient of resistance over a wide range of temperature.

2. Description of the Prior Art

Resistors of electronic components or conductive lines of integrated circuits in prior arts are all with higher temperature coefficients of resistance. The resistivity ratio of the resistance material generally increases 5~20% while temperature is increasing. Once the temperature coefficient of resistance of a resistance component is much higher, the resistance may be highly changed with temperature, and therefore the conductive signals in circuits are unstable as well. It would be obvious that electrical conductive materials with lower temperature coefficients of resistance are more applicable to precision electronics, such as precision resistors, strain gages, thermocouples, etc. Nowadays some methods as controlling manufacturing procedures or adopting complex materials are ready to lower temperature coefficients of resistance.

The applicable temperature ranges of conductive materials, Cu—Ni—Mn Manganin alloy and Cu—Ni Constantan alloy, with lower temperature coefficients of resistance are not wide enough. Therefore if the temperature is over the range, such as 15~30° C. of Manganin alloy and 20~100° C. of Constantan alloy, the resistivity ratios themselves will also be higher so as to restrict such applications.

Thus, to provide a conductive material with a lower temperature coefficient of resistance in a wide temperature range is the best solution to the problems above.

SUMMARY OF THE INVENTION

The present invention provides a new five-component alloy. The atomic concentration of each element is one that is between 16% and 35%, and no one is above 50%. Therefore, the characteristics of such an alloy are based on the combination of the five components.

Multi-componentization is the key to the alloy, since it helps the simplification of the microstructure of the alloy and the microstructure tending to miniaturization. Hence, such an alloy is highly potential to be applied to engineering fields, such as anti-corrosion, hydrogen storage, diffusion barriers, fire resistance, structural framework, abrasion, etc. These so-called "high-entropy alloys" have the advantages of forming nanoscale deposition, stability in high-temperature circumstance and low thermal conductivity.

According to aforesaid, the multi-componentization may let the five-component alloy itself form a simple solid solution with five elements. In fact, the crystal structure of the simple solid solution might be a pseudo-unitary lattice (PUL) or unitary-like lattice (ULL), such as A1-FCC or A2-BCC. The carrier concentration of the five-component alloy is the same as that of a pure metal. On the other hand, compared with a pure metal with lower residual resistivity, the five-component alloy is with the characteristics of higher residual resistivity, 93~162 μΩcm, lower Hall carrier mobility, 0.40~2.61 $cm^2 V^{-1} s^{-1}$, and much lower residual resistivity ratio (RRR), 1.08~1.27, etc. The characteristic of the residual resistivity ratio comes from two reasons of: the higher residual resistivity while the temperature approaches the absolute zero, 0 K; and the increment of the resistivity ratio being relatively lower while the temperature goes up in a wide range of temperature. Thus, higher residual resistivity means that there are lattice defects existed, and the lattice defect is with high density. According to a concept similar to that in the Matthiessen's rule, lowering residual resistivity ratio as temperature increases may indicate that lower phonon effect is a characteristic of the multi-component alloy.

The five-component alloy comprises the following chemical formula:

$$Al_vCO_wCr_xFe_yNi_z,$$

wherein v is in the range of 1.9 to 2.1, w is in the range of 0.9 to 1.1, x is in the range of 0.9 to 1.1, y is in the range of 0.9 to 1.1, and z is in the range of 0.9 to 1.1. In a preferred embodiment, v is in the range of 2.01 to 2.1. In a preferred embodiment, the five-component alloy comprises the following chemical formula: $Al_{2.08}CoCrFeNi$.

A method for producing a multi-component alloy comprises the steps of: providing raw metal materials and mixing the raw metal materials according to the molar ratio of the prescription of the multi-component alloy; disposing the mixed raw metal materials into a furnace and homogeneously smelting each of the raw metal materials under an argon atmosphere protection; cooling and solidifying the smelted raw metal materials in order to obtain the multi-component alloy; and deforming and/or shaping the solidified multi-component alloy to predefined figures and dimensions.

A resistance material with a constant electrical resistivity and a lower temperature coefficient of resistance comprises the following chemical formula: $Al_vCo_wCr_xFe_yNi_z$, wherein v is in the range of 1.9 to 2.1, w is in the range of 0.9 to 1.1, x is in the range of 0.9 to 1.1, y is in the range of 0.9 to 1.1, and z is in the range of 0.9 to 1.1. In a preferred embodiment, v is in the range of 2.01 to 2.1. In a preferred embodiment, the resistance material comprises the following chemical formula: $Al_{2.08}CoCrFeNi$. In a preferred embodiment, the temperature range of the lower temperature coefficient of resistance is between 4.2 and 360 K, the overall temperature coefficient is 72 ppm/K.

Other and further features, advantages, and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Following preferred embodiments and figures will be described in detail so as to achieve aforesaid objects.

Embodiment 1

The Preparation of $Al_{2.08}CoCrFeNi$ of a Five-Component Alloy Sample

The preferred embodiment adopts a plurality of raw metal materials that are Al, Co, Cr, Fe, and Ni, each raw metal material is with the purity of 99.9%, and the raw metal materials are mixed with each other according to the molar ratio of 2.08:1:1:1:1. The embodiment uses a vacuum arc-remelter to smelt such metal materials. That is, the premixed materials about 40 grams are disposed into the vacuum arc-remelter firstly, and the vacuum arc-remelter is pumped to 0.01 bar and then filled with argon to 0.2 bar. The pump and inflation shall be repeated twice, and the procedure of smelting just can be started in order to avoid the alloy from oxidization while in smelting. The electric current of smelting is 420 amperes, and the time is 3 to 5 minutes. One surface of the alloy in the vacuum arc-remelter shall be turned over while each procedure of smelting is finished in order to homogeneously smelt the alloy. After the alloy is turned over for four times, all elements of the alloy being homogeneously smelted can be assured, and the last procedure is to cool down and solidify the alloy so as to obtain a five-component alloy sample.

Embodiment 2

The Preparation of $Al_{2.08}CoCrFeNi$ of a Five-Component Alloy Sample

By JEOL JSM840 SEM (scanning electron microscope) and X-ray EDS (energy dispersive spectrometer), the analyzed result of the sample is shown in Table 1. The crystal structure of the sample is thus tested via a RIGAKU ME510-FM2 X-ray diffractometer. Continuously cutting the thickness of the sample to 2 mm and grinding the cut sample to be smaller than 500 μm in thickness are to increase the signal strength of resistance in measurement. Thereafter cooperating platinum lines with silver paste is to hold the ground sample. At last, the curve (ρ(T)) of resistance to temperature may be measured by means of EG & G Model 5210 Dual Phase Lock-in Amplifiers and four-terminal interlock circuit loop, and the measuring temperature range is between 4.2 K and 360 K.

TABLE 1

X-ray energy dispersive analysis of five-component alloy sample $Al_{2.08}CoCrFeNi$ (in at %)

| Portion | Al | Co | Cr | Fe | Ni |
|---|---|---|---|---|---|
| dendrite | 40.86 | 15.46 | 10.75 | 13.13 | 19.79 |
| interdendrite | 30.65 | 13.32 | 23.25 | 21.32 | 11.46 |
| 500X all | 35.81 | 15.20 | 15.49 | 16.01 | 17.48 |

Figure 1:
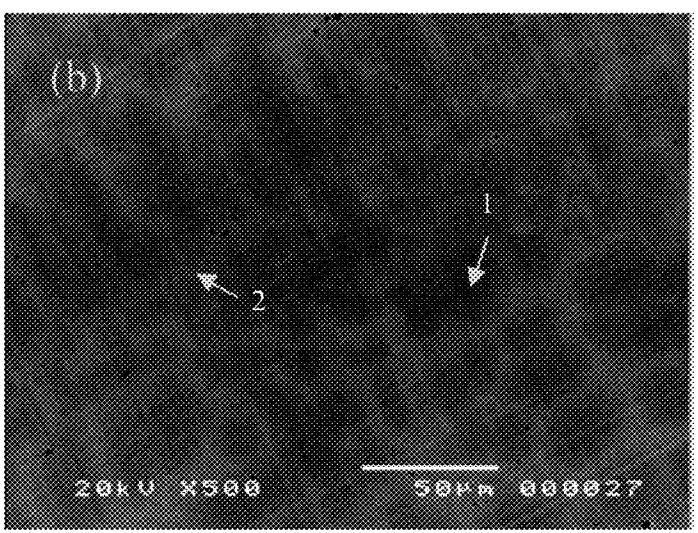
FIG. 1*a* illustrates an XRD pattern of the five-component alloy sample $Al_{2.08}CoCrFeNi$ of the present invention.
FIG. 1*b* illustrates a back-scattered electron image of the five-component alloy sample $Al_{2.08}CoCrFeNi$ of the present invention.
Figure 1:
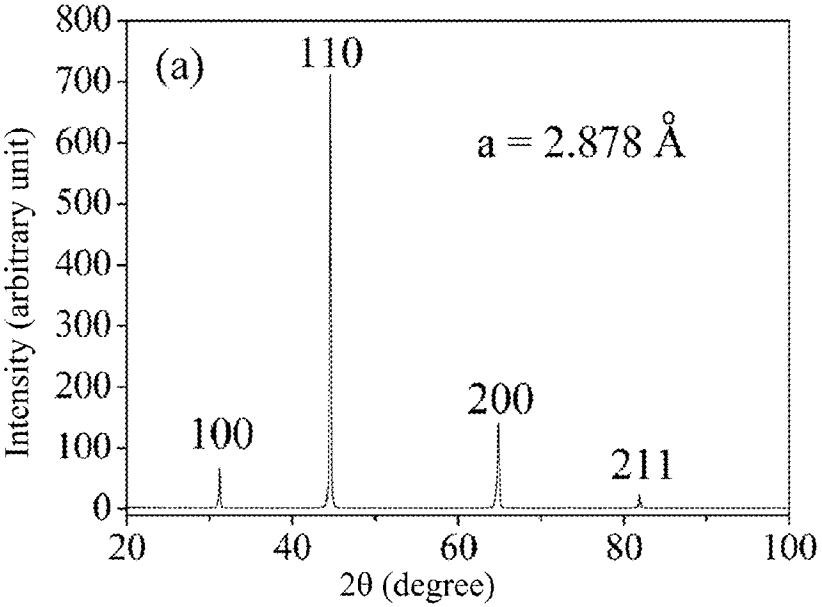

FIG. 1*a* illustrates an XRD pattern of the five-component alloy sample $Al_{2.08}CoCrFeNi$ of the present invention. According to the figure, the five-component alloy sample has the crystal lattice constant of 2.878 Å and is a single ordered B2-BCC structure. FIG. 1*b* illustrates a microstructure of the five-component alloy sample of the present invention. The microstructure consists of black dendrite 1 and gray interdendrite 2. The black dendrite 1 and gray interdendrite 2 are individually rich in Al—Ni phase and poor in Al—Ni phase. The values of saturation magnetization (Ms) of $Al_{2.08}CoCrFeNi$ are 228 and 62 emu/cm$^3$ at the temperatures of 5 and 300 K, respectively. The coefficient of thermal expansion (CTE) is about $8.8\times10^{-6}$/K at 300 K. The aforesaid characteristic is important to a lower CTE.

Figure 2:
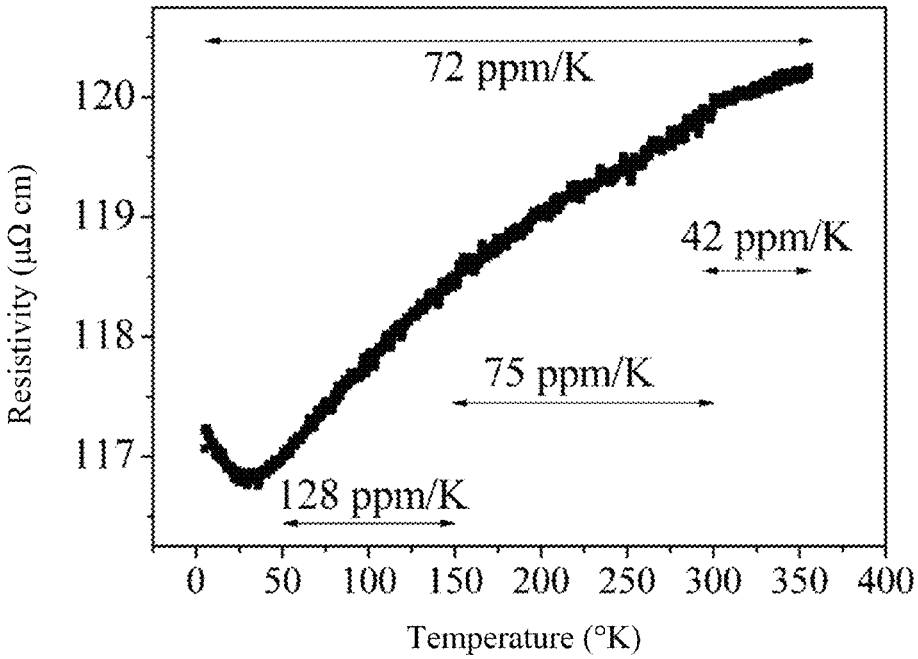
FIG. 2 illustrates a curve (ρ(T)) of resistivity to temperature of the five-component alloy sample $Al_{2.08}CoCrFeNi$ of the present invention.

With reference to FIG. 2, it illustrates a curve (ρ(T)) of resistivity to temperature of the five-component alloy sample $Al_{2.08}CoCrFeNi$ of the present invention. As shown in FIG. 2, the resistivity values are 117.24 and 119.90 μΩcm at 4.2 and 300 K, respectively. Thus the resistivity value of the sample is obviously higher than the resistivity value of traditional crystalline alloys. For example, under the normal atmospheric temperature, the resistivity values of Al, Co, Cr, and Fe are, respectively, 2.74, 5.8, 12.9, and 9.8 μΩcm, while the resistivity value of the sample is lower than that of amorphous alloys, such as in the range of 100 to 1000 μΩcm. The residual resistivity ratio (RRR) of the sample is only 1.02, this is because of the higher residual resistivity value of 117.24 μΩcm at 4.2 K and the lower resistivity increment of only 2.66 μΩcm from 4.2 to 300 K.

The resistivity value of a metal alloy with a lower temperature coefficient of resistance (TCR), smaller than 100 ppm/K, is normally between 100 and 200 μΩcm. In the range of 4.2 to 360 K, the average TCR of the five-component alloy sample $Al_{2.08}CoCrFeNi$ is 72 ppm/K. Such a phenomenon is rare to traditional alloys with lower TCR, and generally speaking, lower TCR shall happen while in smaller temperature range as within 50 K.

Figure 3:
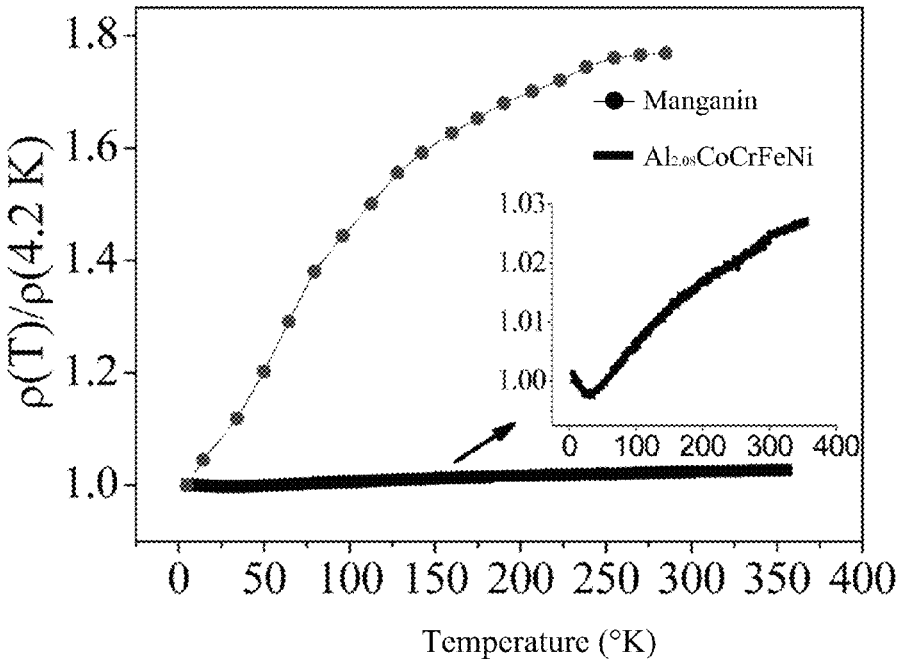
FIG. 3 illustrates curves (ρ(T)) of the resistivity ratio to temperature of a Manganin alloy and the five-component alloy of the present invention.

FIG. 3 illustrates a curve (ρ(T)) of the resistivity ratio to temperature of the five-component alloy of the present invention. At temperatures within the range of 4.2 to 50 K, there occurs a Kondo-like phenomenon, but in the ranges of 50 to 150 K, 150 to 300 K, and 300 to 360 K, the temperature coefficients of resistance of the five-component alloy are, respectively, 128, 75 and 42 ppm/K, and it reminds one that the temperature coefficient of resistance of the five-component alloy goes down while the temperature is higher. The curve (ρ(T)) of the resistivity to temperature being a parabolic curve clearly describes this phenomenon. Based on the point, it is predictable that the five-component alloy shall be with an even lower temperature coefficient of resistance while the temperature is higher than 360 K. As shown in FIG. 3, which provides curves of the five-component alloy and a Manganin alloy, the curves are both semi-parabolic and the increment is thus limited. Since the increment is limited, the high-temperature tendency of the temperature coefficient of resistance of the alloy of the present invention is therefore predictable.

Logically, the five-component alloy sample $Al_{2.08}CoCrFeNi$ should be with a lower temperature coefficient of resistance while the temperature reaches 600 K. Table 2 presents parameters $\rho_0$, A, B, C, and D for an equation $\rho(T)=\rho_0+Aln(T)+BT^2+CT^3+DT$, wherein $\rho_0$ is residual resistivity at 4.2 K.

TABLE 2

Equation $\rho(T) = \rho_0 + A\ln(T) + BT^2 + CT^3 + DT$ of high-entropy alloy sample $Al_{2.08}CoCrFeNi$

| Temp. Range (K) | $\rho_0$ ($\mu\Omega$ cm) | A ($10^{-1}$ $\mu\Omega$ cm) | B ($10^{-4}$ $\mu\Omega$ cm $K^{-2}$) | C ($10^{-6}$ $\mu\Omega$ cm $K^{-3}$) | D ($10^{-2}$ $\mu\Omega$ cm $K^{-1}$) |
|---|---|---|---|---|---|
| 4.2-50 | 117.70 | −2.65 ± 0.01 | −1.45 ± 0.30 | 5.72 ± 0.48 | 0 |
| 50-273 | 116.02 | 0 | −0.270 ± 0.002 | 0 | 2.040 ± 0.007 |
| 273-360 | 117.77 | 0 | 0 | 0 | 0.700 ± 0.006 |

In the equation of $\rho(T)$, parameters A, B, C, and D, respectively, represent coefficients of Kondo, magnetic, and low-temperature and high-temperature phonon terms. The absolute values of the parameters A, B, C, and D go down with increasing temperature. That is, the importance of the parameters related to temperature is gradually less as the temperature is increasing, and therefore the sensitivity of $\rho(T)$ is less to temperature as well. Since the parameters A and B at lower temperatures are negative values, and it is to compensate the parameter C. Thus, the alloy still has a lower temperature coefficient of resistance while at lower temperatures.

At temperatures in the range of 4.2 to 360 K, the five-component alloy sample $Al_{2.08}CoCrFeNi$ has a wide range of a value of lower total-averaged temperature coefficient of resistance (or "overall TCR"), and the value is 72 ppm/K. In the range of 300 to 360 K, the alloy sample has a near-zero TCR (42 ppm/K). Due to the characteristic of the wide temperature range of small temperature coefficient of resistance, the five-component alloy of the present invention can be made to precision electronic elements while at various temperatures.

Comparing with prior arts, the five-component alloy and the method for making the same are with the following advantages:

1. The five-component alloy is able to keep a relatively lower temperature coefficient of resistance in a wide temperature range, from 4.2 to 360 K. Therefore, the five-component alloy has a wider application temperature range than other materials, such as that the application temperature range of the Manganin alloy is between 288 and 318 K, and the application temperature range of the Constantan alloy is between 298 and 373 K.
2. Compared with easily re-crystallized amorphous alloy with a temperature coefficient of 10 ppm/K, the five-component alloy of the present invention has the characteristics of thermal stability, that is, the five-component alloy is hard to re-crystallize and changes its TCR.

Although the invention has been disclosed and illustrated with reference to particular embodiments, the principles involved are susceptible for use in numerous other embodiments that will be apparent for one skilled in the art. This invention is, therefore, to be limited only as indicated by the scope of the appended claims.

What is claimed is:

1. A five-component alloy with a constant electrical resistivity consisting of the following chemical formula:

$$Al_vCo_wCr_xFe_yNi_z,$$

wherein v is in the range of 1.9 to 2.1, w is in the range of 0.9 to 1.1, x is in the range of 0.9 to 1.1, y is in the range of 0.9 to 1.1, and z is in the range of 0.9 to 1.1.

2. The five-component alloy with a constant electrical resistivity according to claim 1, wherein v is in the range of 2.01 to 2.1.

3. The five-component alloy with a constant electrical resistivity according to claim 1 further comprising the following chemical formula: $Al_{2.08}CoCrFeNi$.

4. A method for producing the five-component alloy with a constant electrical resistivity claimed in claim 1, comprising the steps of:

providing raw metal materials and mixing the raw metal materials according to the mole ratio of the prescription of the five-component alloy with the constant resistivity;

disposing the mixed raw metal materials into a furnace and averagely smelting each of the raw metal materials under a protective Ar atmospheric environment;

cooling and solidifying the smelted raw metal materials in order to gain the five-component alloy with the constant resistivity; and deforming and/or shaping the solidified five-component alloy to predefined figures and dimensions.

5. A resistance material with a constant electrical resistivity and a lower temperature coefficient of resistance consisting of the following chemical formula:

$$Al_vCo_wCr_xFe_yNi_z,$$

wherein v is in the range of 1.9 to 2.1, w is in the range of 0.9 to 1.1, x is in the range of 0.9 to 1.1, y is in the range of 0.9 to 1.1, and z is in the range of 0.9 to 1.1.

6. The resistance material with a constant electrical resistivity and a lower temperature coefficient of resistance according to claim 5, wherein v is in the range of 2.01 to 2.1.

7. The resistance material with a constant electrical resistivity and a lower temperature coefficient of resistance according to claim 5, wherein the chemical formula is $Al_{2.08}CoCrFeNi$.

* * * * *